United States Patent [19]

Ulrich et al.

[11] 3,971,343

[45] July 27, 1976

[54] DEVICES FOR THE CLEANING OF HEATING SURFACES

[75] Inventors: Erich Ulrich, Mulheim (Ruhr), Germany; Adrianus Reinier van Liempt, Budel, Netherlands

[73] Assignee: Deutsche Babcock & Wilcox Aktiengesellschaft, Oberhausen (Rhine), Germany

[22] Filed: Mar. 31, 1975

[21] Appl. No.: 563,613

[52] U.S. Cl. ..... 122/379; 165/84

[51] Int. Cl.[2] ..... F28G 7/00

[58] Field of Search ..... 122/379; 165/84

[56] References Cited

UNITED STATES PATENTS

| | | | |
|---|---|---|---|
| 2,183,496 | 12/1939 | Peters | 165/84 |
| 2,550,676 | 5/1951 | Dalin | 165/84 |
| 3,721,217 | 3/1973 | Willach | 122/379 |

*Primary Examiner*—Kenneth W. Sprague
*Attorney, Agent, or Firm*—Roland T. Bryan

[57] ABSTRACT

This invention relates to devices for cleaning the surfaces of pipes, and, in one embodiment particularly useful for cleaning the surfaces of suspended pipe coils in boilers, comprises a drive-cylinder actuated, two-armed lever, interconnected with the pipes to be cleaned by means of upper and lower connectors, wherein the arms of the lever are unequal in length and the distance *c* of its pivot point below the suspension level of the pipe coils with which it is associated, is equal to 2ab/(a+b), where *a* is the distance of the upper connector from said suspension level and *b* is the distance therefrom of the lower connector.

11 Claims, 5 Drawing Figures

DEVICES FOR THE CLEANING OF HEATING SURFACES

BACKGROUND OF THE INVENTION

In the past, jarring devices have proved useful for the purpose of cleaning the heating surfaces of pipe coils, particularly where such heating surfaces of pipe coils have been exposed to gases which are heavily particle-laden. For example, they have been used, among other things, in the waste-heat boilers of calcining furnaces. By means of such jarring devices, which may be operated at predetermined time intervals, adherent particles are loosened and shed from the outer surface by the jarring of the pipe coils against each other. Known jarring devices of this type may be regulated as to jarring frequency by monitoring the temperature of the effluent gas, since it will rise as the pipes become particle covered and; therefore, less efficient in heat transfer capability. In this connection reference is made to U.S. Pat. No. 3,721,217. With such jarring devices, however, there is a danger that the periodic forces arising from the motion of the pipe coil masses may transfer, by way of their bearing elements, onto the body of the boiler and its supporting structures. Therefore, the bearing elements must be designed and/or dimensioned to withstand such extra dynamic loads. In addition, the transfer of periodic alternating forces from the masses in motion may produce troublesome oscillations, (i.e., resonance) in supporting structures, scaffolding and/or buildings, which might, under certain circumstances, totally or partially destroy, or at least damage, portions of the installation. Alternatively, the period of jarring may be varied to reduce such adverse effects, but this is undesirable because this makes the frequency of jarring, and therefore the cleaning effectiveness and periods, depend on considerations not necessarily, or even usually, related to the factors which are relevant to the rate of particle accumulation.

Therefore, an object of this invention is to provide a means for the cleaning of the heating surfaces of pipe coils in such a way as to minimize or minimize or prevent the transfer of forces to the body of the boiler from the pipe coil masses as they move.

SUMMARY OF THE INVENTION

Desired objectives may be achieved through practice of the present invention which, in one embodiment, comprises a drive-cylinder actuated, two-armed lever, which is pivotally interconnected with suspended pipe coils which are to be cleaned by upper and lower connecting means, wherein the lever arms of the two-armed lever are of unequal length and the pivot of said lever is so positioned that it resides at a distance $$c = \frac{2ab}{a+b}$$

below the suspension level at which the pipe coils are pivotally mounted, wherein $a$ denotes the distance of the upper connecting means, and $b$ the distance of the lower connecting means, respectively, from the pivot points of the pipe coils at the suspension level, and wherein the length of the upper lever arm $r_1$ and the lower lever arm $r_2$ respectively are $(c-a)$ and $(b-c)$; whereby forces and moments induced by jarring of the coils are offsetting, and objectionable oscillations in the boiler body during the jarring operation may be avoided.

DESCRIPTION OF DRAWINGS

This invention may be understood from the accompanying description and drawings in which.

DESCRIPTION OF PREFERRED EMBODIMENT

Figure 1:
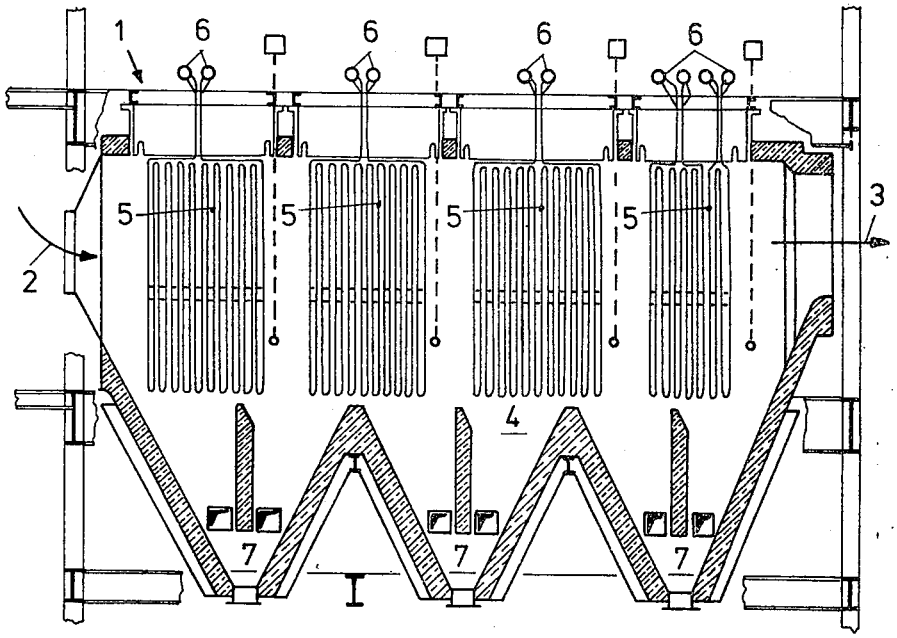
Fig. 1 PRIOR ART
FIG. 1 is a lengthwise/cross-section through a waste heat boiler in which devices according to this invention may be used.
Figure 2:
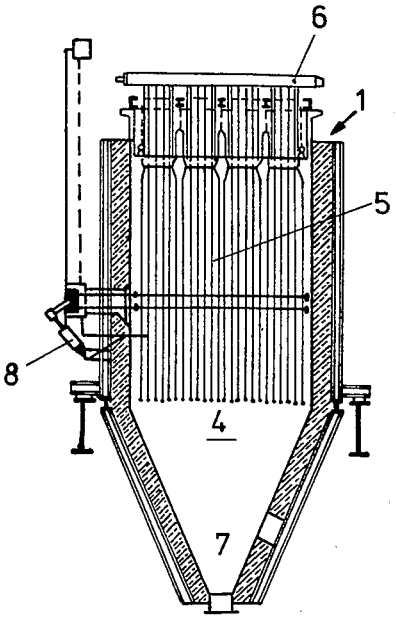
Fig. 2 PRIOR ART
FIG. 2 is a transverse section of the boiler shown in FIG. 1, FIG. 3, is a perspective view of a prior art mechanism for use with a jarring device.

Referring first to FIG. 1, there is shown a waste heat boiler 1 in which embodiments of the present invention may be used. In normal use, the boiler is traversed by particle-laden waste gases in the direction of the arrows 2 and 3. The waste gas duct 4 is positioned horizontally to accommodate four nests of pipe coils 5. These pipe coil nests 5 are suspended and are oriented generally perpendicular to the direction of the waste gas flow. The pipe coils 5 are fed by collectors 6 located above the waste gas duct 4. Below the pipe coils, provision has been made for ash or particle funnels 7. FIG. 2 further illustrates this embodiment, but in a section which is transverse to that shown in FIG. 1.

Figure 3:
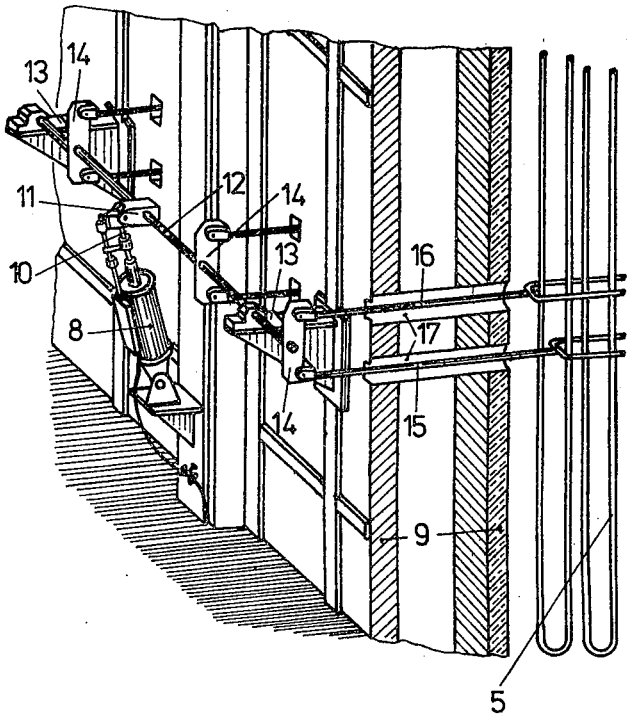
Fig. 3 PRIOR ART

As shown in FIG. 3, a jarring device associated with the pipe coil nest 5 may consist of a hydraulically or pneumatically actuated cylinder 8, the lower end of which is secured to boiler wall 9. The piston rod 10 projecting from its upper end is linked to shaft 12 by means of a one-armed lever 11; the shaft resting on a support 13 which is also secured to the boiler wall. Positioned on shaft 12 are two-armed levers 14, whose free extremities are respectively connected to connector means in the form of cooled, hollow pipes 15 and 16. These hollow pipes 15, and 16 project through an opening 17 in the wall of the boiler 9 and on to the pipe coils in such a way that the individual pipe coils are alternatingly connected to the lower or the upper hollow pipes. Reciprocating motion of the piston rod 10 causes the pipe coils to move back and forth; whereby, in each case, the two adjoining pipe coils may be caused to move against each other.

Figure 4:
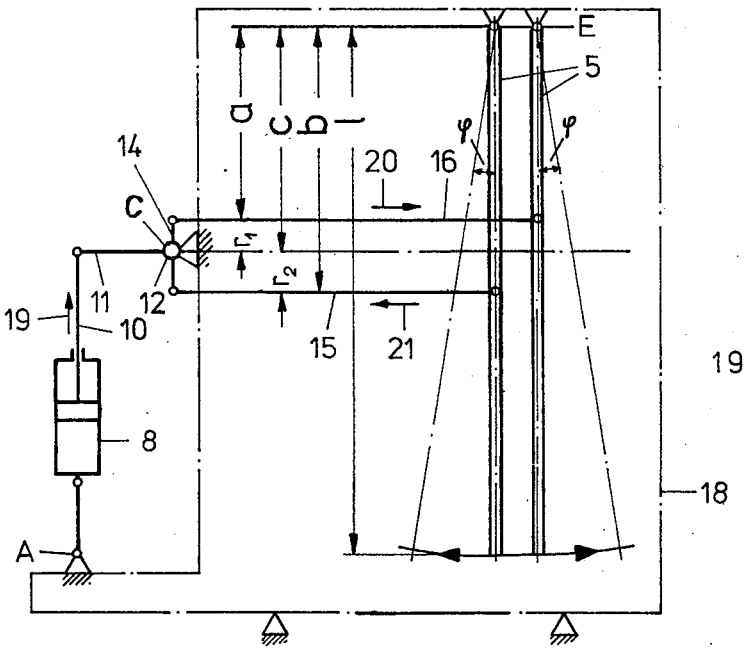
FIG. 4, is a schematic arrangement of a jarring device embodying the present invention.

FIG. 4 is a simplified illustration of the geometric arrangement of a device embodying this invention associated with two adjoining pipe coils. Line 18 represents the frame of the boiler, supporting the drive cylinder 8 at point A and the shaft 12 at fulcrum C; the pipe coils being suspended from pivot points along the level E. When the piston rod is moved in the direction of the arrow 19, the upper hollow pipe 16 moves in the direction of arrow 20, and the lower hollow pipe 15 in the direction of arrow 21. In the process, the two pipe coils have imparted to them the same angular displacement $\tau$. To achieve this end, the operating lever arms $r_1$ and $r_2$ of the two-armed lever 14 are of unequal length. The length of each of the lever arms is determined by the distance $C$ of the pivot C from the suspension level E and $c$ in turn is calculated from the distances $a$ and $b$ of the hollow pipes 16 and 16 from the suspension level E.

As an example, for a waste heat boiler with four suspended nests of pipe coils, designed for a steam output of 20 metric tons per hour, the pipe length was selected at 4,000mm below the suspension level E. Based on design considerations, $a$ was set at 2,260mm and $b$ at 2,560mm. From the expression $$c = \frac{2ab}{a+b}$$

we obtain $c = 2{,}400$mm. Hence, the effective length of each of the lever arms $r_1$ and $r_2$ is $(c - a)$, $(b - a)$ respectively, or 140mm and 160mm respectively. A jarring device so constructed will transmit no substantial induced forces into the body of the boiler, and therefore the physical arrangement of the drive cylinder and the time intervals at which it is to operate can be chosen at will and in accordance with the rate of particle accumulation, rather than being restricted by considerations of force resonances.

Figure 5:
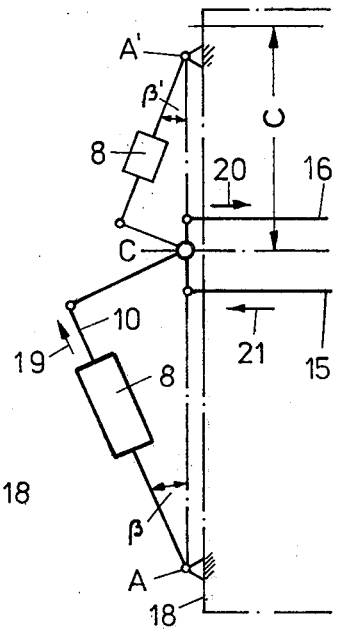
FIG. 5, is a schematic arrangement of a jarring device embodying the present invention.

In FIG. 4, the drive cylinder 8 is arranged vertically. As shown in FIG. 5, a drive cylinder may be inclined at an angle $\beta$ to the vertical, whereby the point A supporting the drive cylinder on the frame of the boiler lies below the fulcrum C, is similar to the arrangement shown for the apparatus in FIG. 3. Alternatively, as shown in the upper portion of FIG. 5, the cylinder also can be secured above the fulcrum C. It is to be understood that the embodiments herein discussed and illustrated are by way of illustration and not of limitation and that other embodiments of this invention may be made by those skilled in the art without departing materially from the spirit or scope of this invention.

We claim:

1. In a heat exchange apparatus having walls enclosing a heat exchange passage in which heated pipe coils adjacent to one another are suspended at their upper ends at a predetermined level in said apparatus and wherein a jarring means is attached to at least one of said walls and to said pipe coils to clean the coils by jarring vibration;

said jarring means having a lever mounted by a first pivot means to one of said walls and connected to said selected pipes in said pipe coils;

said lever having an upward extending arm and a lower extending arm;

a piston attached to the heat exchanger wall at one end and at its opposite end to said lever to impart vibration to said coils;

a first substantially horizontal connecting means connected to the upper end of said upward extending arm and to selected pipes in said pipe coils;

a second substantially horizontal connecting means connected to the lower end of said downward extending arm and to selected pipes in said pipe coils;

the improvement comprised said upper extending and lower extending lever arms being of unequal length;

said first horizontal connecting means connected to one of said selected pipes at a vertical distance $a$ from the level from which said pipes are suspended;

a second pivot connecting said first connecting means to said upward extending arm;

said second horizontal connecting means connected to another of said selected pipes at a vertical distance $b$ from the level from which said pipes are suspended;

a third pivot connecting said second connecting means to said downward extending arm;

said first pivot located at a vertical distance $c$ from the level from which said pipes are suspended where:

$$c = \frac{2ab}{a+b}$$

2. The apparatus described in claim 1 wherein said connecting means are hollow pipes.

3. The apparatus described in claim 1 wherein said first pivot is the axis of a shaft which is rotatably interconnected with said piston.

4. The apparatus described in claim 2 wherein said first pivot is the axis of a shaft which is rotatably interconnected with said piston.

5. The apparatus described in claim 3 wherein the axis of said lever is at substantially right angles to an imaginary line connecting the pivot points between said upwardly and downwardly extending arms and their associating connecting means.

6. The apparatus described in claim 4 wherein the axis of said lever is at substantially right angles to an imaginary line connecting the pivot points between said upwardly and downwardly extending arms and their associating connecting means.

7. In a heat exchanger having pipe coils which are suspended at their upper end therein from pivots, an apparatus for cleaning the outer surfaces of said pipes by causing them to strike against each other, comprising upper and lower substantially horizontal connector means, each of which is pivotally interconnected at one of its respective ends with different of said pipes than the other of said means, and motion means for causing the upper of said connecting means to move horizontally concurrently with the lower of said connecting means and counterdirectionally thereto by a distance which is shorter than and in an established proportion to the distance traveled by said lower connecting means, which distances are directly proportional to the distance of said means from the suspension pivots of the pipes with which each is interconnected, whereby upon movement of said connecting means, the pipes to which they are connected will be caused to move through substantially equal degrees of arc about their respective suspension pivot points.

8. The apparatus described in claim 7 wherein said motion means comprises upper lever arm means pivotally interconnected with other end of said upper connector means and lower lever arm means pivotally interconnected with the other end of said lower connected means.

9. The apparatus described in claim 8 wherein said upper lever arm means and said lower lever arm means are positionally fixed with respect to each other.

10. The apparatus described in claim 9 wherein said arm means are integral with a pivotally mounted lever arm support means.

11. The device described in claim 10 wherein the vertical distance between the pivot of said lever arm means, said upper connector means, and said lever connector means respectively and said suspension pivots of said pipe coils is $c$, $a$, and $b$ respectively, where $$c = \frac{2ab}{a+b}$$

and wherein the length of the upper lever means and lower lever means respectively are $r_1$ and $r_2$, where $r_1 = (c - a)$ and $r_2 = (b - a)$.

* * * * *